US005924166A

United States Patent [19]

Jones et al.

[11] Patent Number: 5,924,166

[45] Date of Patent: Jul. 20, 1999

[54] CLEANING GUN ADJUSTABLE TO BLOWING AND SUCTION FUNCTIONS

[76] Inventors: Christopher R. Jones, 3608 Madison Ave., Greensboro, N.C. 27403; Darrell K. Terpstra, 305 Canterbury Rd., High Point, N.C. 29262

[21] Appl. No.: 08/979,677

[22] Filed: Nov. 26, 1997

Related U.S. Application Data

[63] Continuation-in-part of application No. 08/680,459, Jul. 15, 1996.

[51] Int. Cl.[6] ..... A47L 5/18

[52] U.S. Cl. ..... 15/330; 15/344; 15/409

[58] Field of Search ..... 15/344, 409, 330

[56] References Cited

U.S. PATENT DOCUMENTS

| | | | |
|---|---|---|---|
| 1,078,512 | 11/1913 | Mills | 15/330 |
| 2,902,708 | 9/1959 | Riley | 15/330 |
| 3,525,118 | 8/1970 | Viollet | 15/330 |
| 3,578,948 | 5/1971 | Friend et al. | 156/409 X |
| 3,683,446 | 8/1972 | Tell | 15/330 |
| 3,964,123 | 6/1976 | Pettersson | 15/409 X |
| 3,967,341 | 7/1976 | Gavin | 15/409 X |
| 4,055,870 | 11/1977 | Furusutsumi | 15/409 X |

FOREIGN PATENT DOCUMENTS

| | | | |
|---|---|---|---|
| 1022770 | 1/1958 | Germany | 15/409 |
| 1211930 | 11/1970 | United Kingdom | 15/330 |

*Primary Examiner*—Chris K. Moore
*Attorney, Agent, or Firm*—Clifton Ted Hunt

[57] ABSTRACT

The cleaning gun of this invention is equipped for connection to a source of compressed air under 80 psi, and with a directional dial that is mutually adjustable to cause a vacuum to draw in ambient air through an inlet/outlet tube as for removing oily dust and lint from machinery, and to cause air to be blown through the inlet/outlet tube under a maximum of 30 psi as for removing dry dust and lint from machinery and clothing.

8 Claims, 5 Drawing Sheets

CLEANING GUN ADJUSTABLE TO BLOWING AND SUCTION FUNCTIONS

CROSS REFERENCE TO RELATED APPLICATIONS

This application is a continuation-in-part of our pending patent application Ser. No. 08/680,459, filed Jul. 15, 1996 for COMPRESSED AIR AND VACUUM CLEANING GUN.

FIELD OF THE INVENTION

This invention relates to apparatus that uses compressed air for blowing a stream of air from the apparatus into the ambient atmosphere and for sucking air in the apparatus from the ambient atmosphere. More specifically, the apparatus is adjustable to use compressed air to create a vacuum that draws air in the apparatus to remove oily dust and lint from the surface of machinery or other objects, and is adjustable to blow compressed air from the apparatus under a reduced pressure to remove dry dust and lint from the surface of machinery, clothing and other objects.

BACKGROUND OF THE INVENTION

Apparatus that operates with compressed air and is adjustable to either blow air or create a vacuum for cleaning machinery is known in the prior art. See, for example, U.S. Pat. No. 1,078,512 to Mills, U.S. Pat. No. 3,525,118 to Viollet, U.S. Pat. No. 3,683,446 to Tell and British Patent No. 1,211,930 to Herre.

The Herre patent is the closest known prior art to applicants' invention. Herre employs an air gun with an "ejector" or venturi tube to create a suction with compressed air. The suction currents empty through a flexible tube into a fabric container. The compressed air is redirected to blow from Herre's air gun when the flexible tube is closed by manually pinching it together, and thereby redirecting the compressed air to blow outwardly from the air gun.

In the Herre apparatus, the suction currents are directed out the back of the gun, toward the operator using the device, possibly projecting debris against the operator and causing serious injury. Herre's flexible pinch tube could be inadvertently bent to accidentally close the tube during a vacuum function, causing the air and debris collected during the suction function to change direction and be blown out the nozzle with possible damage.

Compressed air is conventionally delivered at a pressure of 80 pounds per square inch (80 psi) to pneumatic equipment in factories, but the Occupational Safety Hazards Act (OSHA) limits the air pressure to 30 psi when compressed air is blown into the ambient air of a factory. The apparatus disclosed in the British patent to Herre will not meet OSHA's 30 psi regulation.

These safety hazards, and others, are overcome by the present invention.

SUMMARY OF THE INVENTION

The cleaning gun of this invention is particularly intended for use in the apparel manufacturing industry, but its utility is not so limited. It is a lightweight hand-held cleaning device that operates with compressed air at a specific pressure, such as 80 psi, to either create a powerful vacuum or to blow air within the OSHA standard of 30 psi.

The function of the cleaning gun is changed to either blowing or sucking by manual operation of a single control.

A directional dial, having an open-ended air passage extending through it, must be manually turned with enough force to minimize the risk of accidentally changing the function of the cleaning gun from blowing to suction, or vice versa.

An air tube in the cleaning gun has an inlet for connection to a source of compressed air, and the air tube delivers the compressed air through an air jet nozzle to a vacuum chamber. The vacuum chamber communicates directly with an inlet/outlet tube, and communicates with an exhaust tube through the directional dial. Manual rotation of the directional dial positions its air passage in full alignment with the exhaust tube to direct all of the compressed air through the exhaust tube and create a suction that draws ambient air into the inlet/outlet tube, through the air passage and through the exhaust tube. The strength of the suction is increased by an enlarge diameter at the end of the exhaust tube.

The air currents that are created and the debris that is collected by suction are directed downwardly, away from the operator, into a foraminated collection bag within a sturdy housing. This safety feature is in sharp contrast to the collection of debris in the unprotected fabric bag that faces the operator at the rear of Herre's air gun.

When the directional dial is manually rotated to change the function of the cleaning gun from suction to blowing, the air passage in the directional dial is moved from full to partial alignment with the vacuum chamber and the directional dial to divert some of the compressed air entering the vacuum chamber to the inlet/outlet tube. A specific amount of air continues to move through the exhaust tube, thereby reducing the pressure of the air blown through the inlet/outlet tube from 80 psi to a maximum of 30 psi, in compliance with the OSHA requirement.

DETAILED DESCRIPTION OF THE INVENTION

Figure 1:
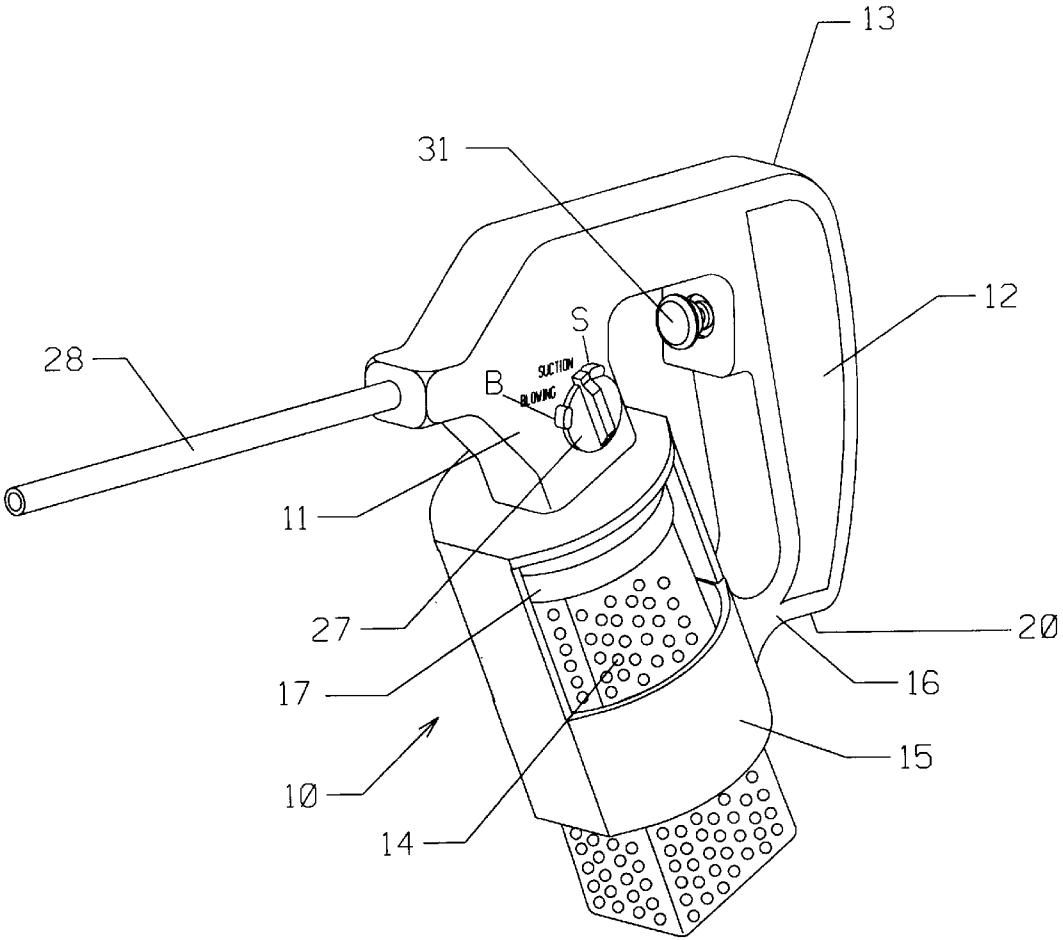
FIG. 1 is a perspective view of the cleaning gun.
Figure 4:
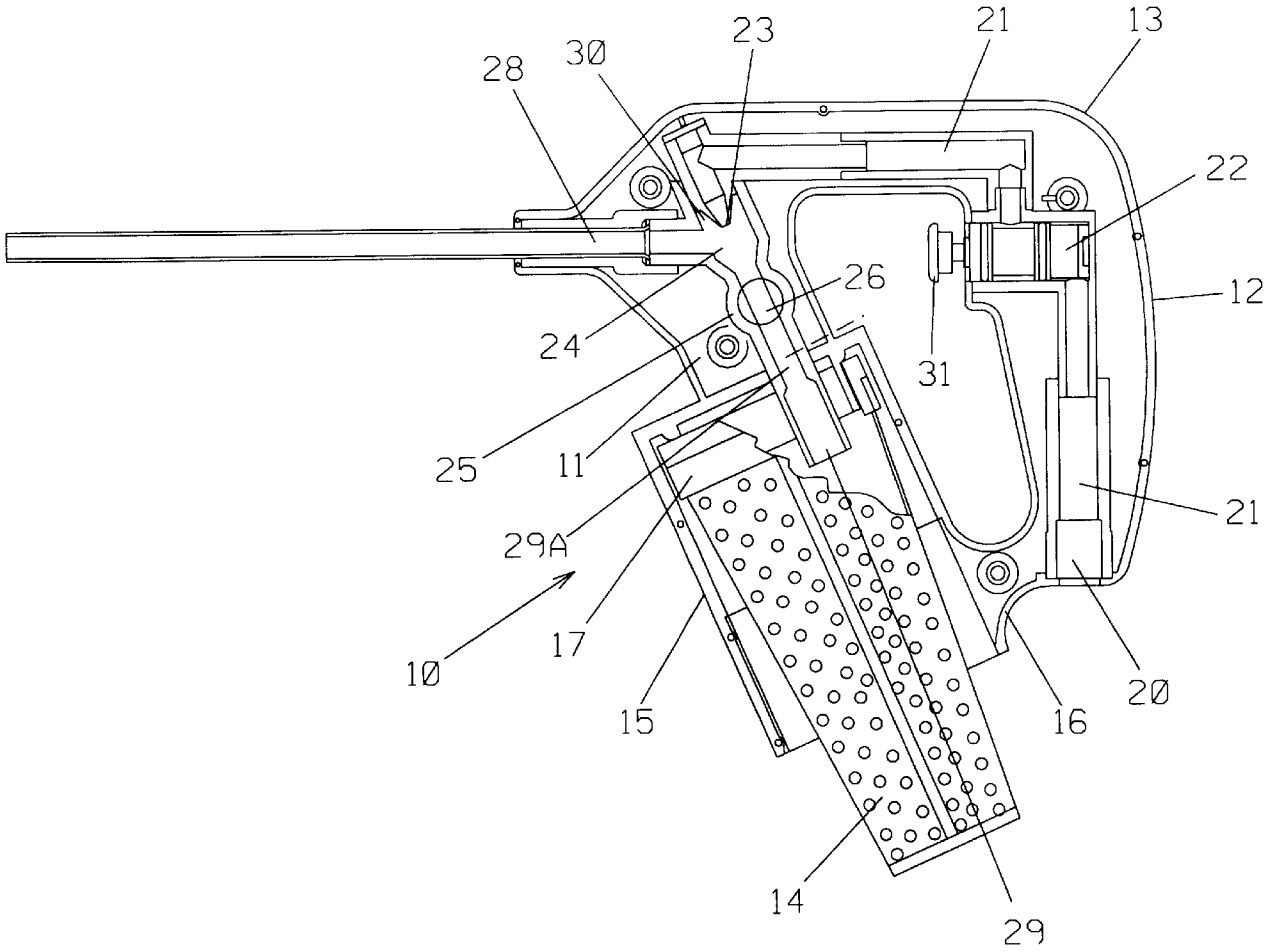
FIG. 4 is a sectional view, partially in elevation, of the cleaning gun, with the directional dial adjusted for the suction function of the gun.
Figure 7:
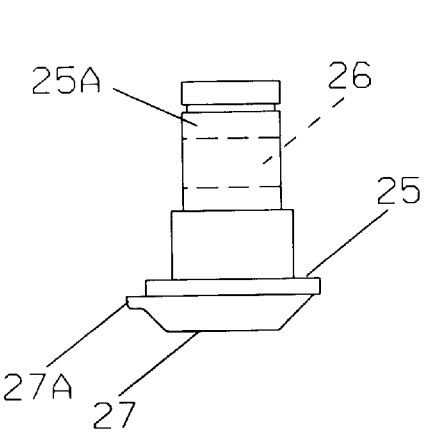
FIG. 7 is a side view of the directional dial shown in FIG. 5, looking at a side not shown in FIG. 6 and showing the air passage in dotted lines.
Figure 8:
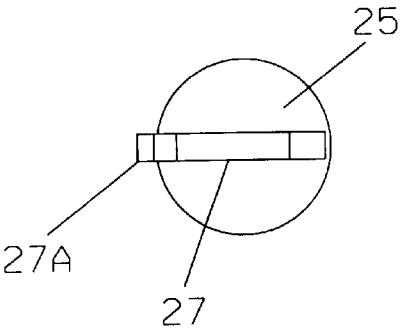
FIG. 8 is a top view of the directional dial shown in FIG. 5.
Figure 6:
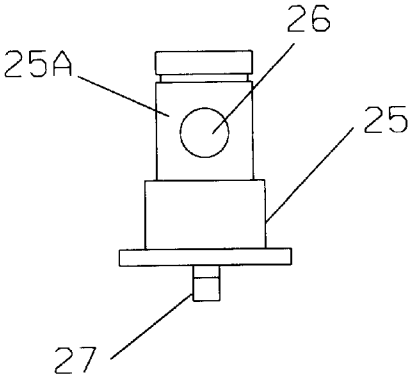
FIG. 6 is a side view of the directional dial shown in FIG. 5, looking at one end of the air passage that extends through the directional dial.
Figure 5:
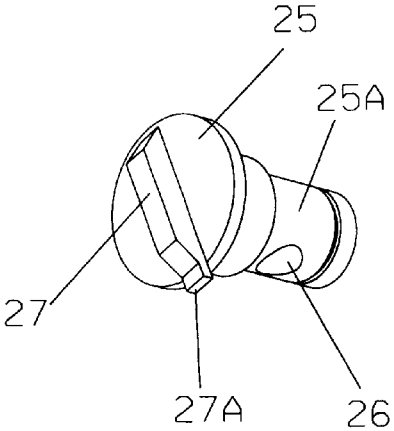
FIG. 5 is a perspective view of the directional dial, removed from the cleaning gun.

Referring more specifically to the drawings, the cleaning gun is broadly indicated at 10, and comprises a body portion 11 formed integrally with a handle 12. The top of the handle 12 is joined to the body 11 by a rounded corner, as at 13. A foraminated collection bag 14 is seated in a retainer collar 17 that is attached to a housing 15 that forms the bottom of the body portion 11. The bottom of the handle 12 is joined as at 16 to the housing 15 (FIGS. 1 and 4). The retainer collar 17, with collection bag 14, can be removed to empty the debris when full.

Figure 2:
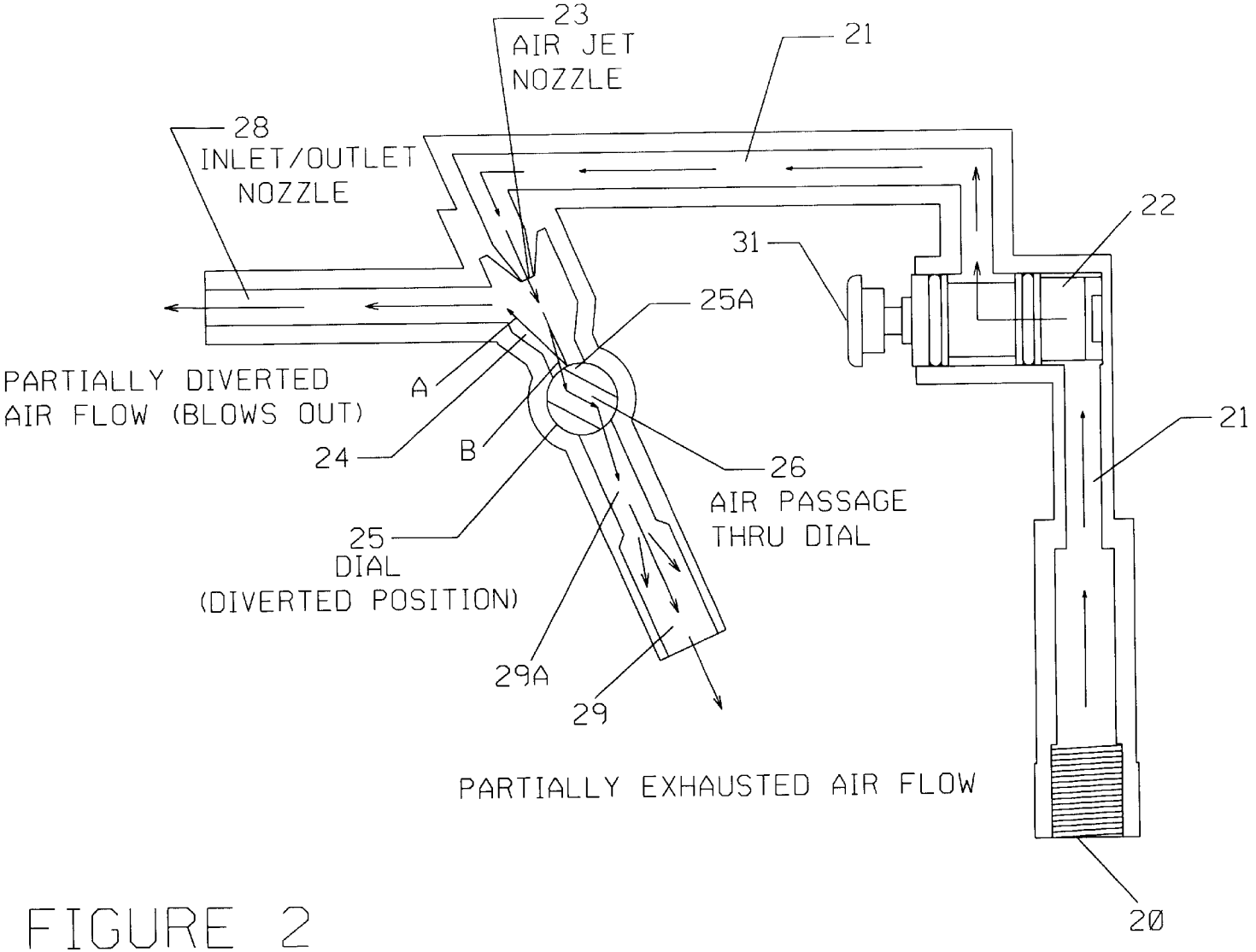
FIG. 2 is a somewhat schematic sectional view of the cleaning gun, with the directional dial adjusted for the blowing function of the gun and with directional arrows illustrating the path of the air.
Figure 3:
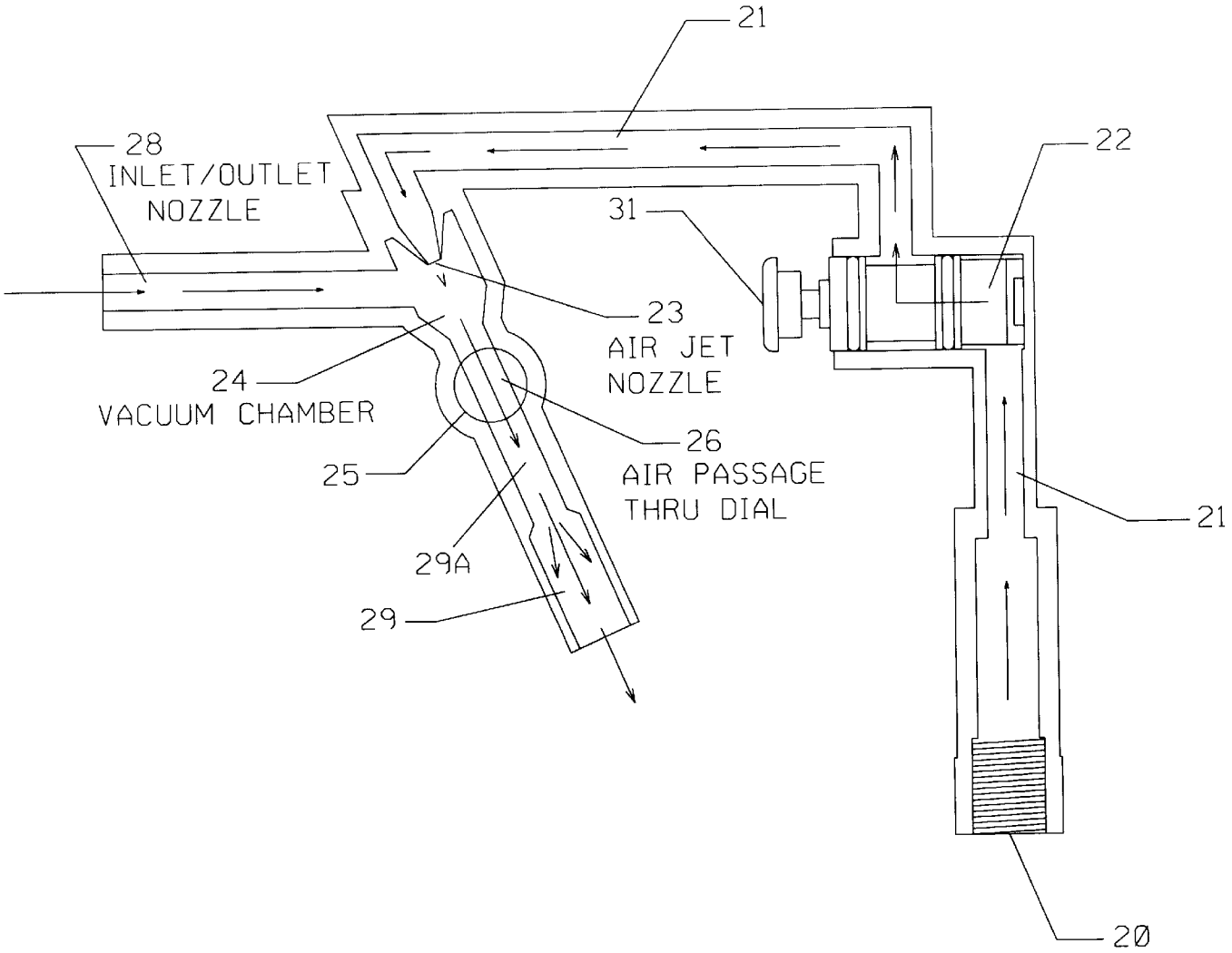
FIG. 3 is a somewhat schematic sectional view of the cleaning gun, with the directional dial adjusted for the suction function of the gun and with directional arrows illustrating the path of the air.

Referring to FIGS. 2–4, a compressed air inlet 20 is located at the bottom of the handle 12. An air tube 21 extends from the inlet 20 past a valve 22 in the handle 12 to an air jet nozzle 23 in the body portion 11. The air jet nozzle 23 discharges compressed air through a vacuum chamber 24 within the body portion 11 into an open-ended passage 26 extending through a directional dial 25.

The Directional Dial

The directional dial 25 (FIGS. 5–8) is rotatably journaled in the body portion 11 between the vacuum chamber 24 and an exhaust tube 29/29A. The directional dial is manually operable by a handle 27 to orient its air passage 26 into either full or a predetermined partial alignment with the air jet nozzle 23, vacuum chamber 24, and exhaust tube 29/29A for either suction or blowing, respectively.

The orientation of the air passage 26 in the directional dial 25 determines the pressure of the air that blows outwardly through the inlet/outlet tube 28. If the air passage 26 was to be placed completely out of alignment with the exhaust tube 29/29A, the cleaning gun would blow air through the inlet/outlet tube 28 under full pressure, 80 psi, for example. If the air passage 26 is in full alignment with the exhaust tube 29/29A, no air is blown through the inlet/outlet tube 28. The pressure of the air that blows outwardly through the inlet/outlet tube 28 increases with the decrease of the alignment between the air passage 26 and the exhaust tube 29/29A.

An indicator 27A extends from one end of the handle 27 for selective registration with designations for "Blowing" and "Suction", indicated at B and S, respectively, on the body portion 11 (FIG. 1). When the suction function is desired, the handle 27 is manipulated to register the indicator 27A with the designation S. This location of the directional dial, for the suction function, causes the air passage 26 to be in full alignment with the air jet nozzle 23, vacuum chamber 24 and the exhaust tube 29/29A (FIGS. 3 and 4).

When the blowing function is desired, the handle 27 is manipulated to register the indicator 27A with the designation B. This location of the directional dial 25 causes air passage 26 to be in only the predetermined partial alignment with the air jet nozzle 23, vacuum chamber 24 and the exhaust tube 29/29A for the blowing function of the cleaning gun.

As best seen in FIG. 2, the placement of the air passage 26 in position for the blowing function moves part 25A of the dial 25 into the path of the compressed air from the air jet nozzle 23 and diverts air upwardly into the inlet/outlet tube 28, as indicated by the directional arrow A in FIG. 2. The remainder of the air continues to flow through the air passage 26 to the exhaust tube 29/29A, as indicated by the directional arrow B in FIG. 2.

FIG. 2 shows the directional dial 25 oriented to place the air passage 26 through the directional dial 25 into only partial alignment with the air jet nozzle 23, the vacuum chamber 24 and the exhaust tube 29/29A. So arranged, the cleaning gun functions as a blower because some of the compressed air that flows into the vacuum chamber 24 from the air jet nozzle 23 is diverted to blow outwardly through the inlet/outlet tube 28, while some air continues to flow through the partially aligned air passage 26 and exits through the exhaust tube 29/29A and foraminated bag 14.

The degree or extend of "partial alignment" of air passage 26 with air jet 23, vacuum chamber 24 and exhaust tube 29/29A is predetermined to divert air through the inlet/outlet tube 28 under a desired pressure, such as the 30 psi allowed by OSHA.

The Vacuum Function

FIGS. 3 and 4 show the directional dial adjusted for the cleaning gun to function as a vacuum cleaner. The air passage 26 is oriented to be in full alignment with the air jet nozzle, the vacuum chamber 24, and the exhaust tube 29/29A. The orifice (opening) in the air jet nozzle 23 is of significantly less diameter than that of air passage tube 21, allowing for a stream of compressed air to be directed through vacuum chamber 24 and into air passage 26 located in directional dial 25. The compressed air then passes through the exhaust tube 29/29A. The results of this action is a venturi effect which allows the cleaning gun to function as a vacuum cleaner by drawing ambient air and debris into the inlet/outlet tube 28 and exhausting air and debris through the exhaust tube 29/29A, and depositing the debris into the foraminated collection bag 14.

With the handle 27 set for "Suction", and with the inlet 20 operably connected to a source of compressed air (not shown), the cleaning gun 10 is manually activated for suction by depressing a valve button 31 to activate the valve 22 and admit air through the air tube 21, the air jet nozzle 23, the relatively large vacuum chamber 24, and the exhaust tube 29/29A, causing the vacuum that creates a negative pressure in the inlet/outlet tube 28. The negative pressure sucks ambient air and debris inwardly through the inlet/outlet tube 28 to the vacuum chamber and thence through the exhaust tube 29/29A to the foraminated collection bag 14.

The outer portion 29 of the exhaust tube 29/29A has a larger inside diameter than that of the inner portion 29A. This increases expansion of the exhausted air, resulting in a stronger suction flow inwardly through the inlet/outlet tube 28.

The Blowing Function

The cleaning gun is manually activated to blow air through the inlet/outlet tube 28 by manipulating the handle 27 on the directional dial 25 to the "Blowing" position, indicated at B in FIG. 1, and then pressing the valve button 31 to admit compressed air through the air tube 21, air jet nozzle 23, and vacuum chamber 24. Manipulating the handle 27 of the directional dial 25 for the "Blowing" function places the air passage 26 through the directional dial in a predetermined partial alignment with the air jet nozzle 23, vacuum chamber 24 and exhaust tube 29/29A, as seen in FIG. 2. So positioned, a predetermined volume of the air flows through the partially aligned air passage 26 while the directional dial with the partially aligned air passage 26 diverts the remainder of the compressed air to blow outwardly through the inlet/outlet tube 28 for cleaning purposes.

No damage will result if the inlet/outlet tube 28 becomes completely obstructed and closed off, because the air passage tube 26 in the directional dial 25 will remain in partial alignment with the exhaust tube 29/29A and air will continue to be exhausted through the foraminated collection bag 14.

There is thus provided an improved cleaning gun that has apparatus with a positive control for converting compressed air to a powerful suction and for reducing to a safe pressure air that is blown from the cleaning gun, when desired.

We claim:

1. A cleaning gun adjustable to perform either a blowing function or a vacuum function, the cleaning gun comprising an air tube, means for connecting one end of the air tube to a source of compressed air, an air jet nozzle connected to the opposite end of the air tube, a vacuum chamber in communication with the air jet nozzle, an inlet/outlet tube communicatively connected to the vacuum chamber and extending in one direction from the vacuum chamber, an open ended exhaust tube extending from the vacuum chamber in an angular direction from said one direction, an open-ended air passage providing communication between the air jet nozzle and the exhaust tube, and means for selectively moving the open ended air passage into either full alignment with the air jet nozzle, the vacuum chamber and the exhaust tube for the vacuum function or into flow communication in a non-aligned manner with the air jet nozzle, the vacuum chamber and the exhaust tube for the blowing function.

2. The invention of claim 1 wherein said means for selectively moving the open ended air passage into full alignment or flow communication in a non-aligned manner with the air jet nozzle, vacuum chamber and exhaust tube moves the air passage into only a specific predetermined partial alignment with the air jet nozzle, the vacuum chamber and the exhaust tube for the blowing function.

3. The invention of claim 2 wherein said means is a directional dial rotatably journaled between the vacuum chamber and the exhaust tube, the directional dial housing the air passage and being journaled for rotation between a first fixed point that places the air passage in full alignment with the air jet nozzle, the vacuum chamber and the exhaust tube and a second fixed point that places the air passage in specific predetermined flow communication with the air jet nozzle, the vacuum chamber and the exhaust tube.

4. The invention of claim 3 wherein the pressure of the air at said source of compressed air is 80 psi, and the specific predetermined flow communication of the air passage with the air jet nozzle, the vacuum chamber and the exhaust tube diverts air outwardly through the inlet/outlet tube under a maximum pressure of 30 psi.

5. The invention of claim 3 wherein the cleaning gun includes a foraminated bag mounted in communication with the end of the exhaust tube that is remote from the vacuum chamber.

6. The invention of claim 1 wherein the cleaning gun includes a foraminated bag mounted in communication with the end of the exhaust tube remote from the vacuum chamber.

7. The invention of claim 6 wherein the angular direction that the exhaust tube extends from the one direction of the inlet/outlet tube is at least 90° downwardly from the inlet/outlet tube.

8. A cleaning gun adjustable to blowing and vacuum functions, the cleaning gun comprising a body portion, an air tube within the body portion, an inlet at one end of the air tube for attachment to a source of compressed air, an air jet nozzle at the other end of the air tube, a trigger/valve in the air tube between the inlet and the air jet nozzle, a vacuum chamber in the body portion in communication with the air jet nozzle, an inlet/outlet tube extending from the vacuum chamber, a directional dial having an open ended air passage extending therethrough, means for rotating the directional dial to place one end of the air passage in different degrees of alignment with the air jet nozzle and the vacuum chamber, an open ended exhaust tube communicating at a first end with the air passage in the directional dial, a foraminated collection bag communicating with a second end of the exhaust tube that is remote from the directional dial, and the second end of the exhaust tube being of a greater diameter than the first end of the exhaust tube.

* * * * *